US006821232B1

(12) United States Patent
Wang et al.

(10) Patent No.: US 6,821,232 B1
(45) Date of Patent: Nov. 23, 2004

(54) CUSHIONING UNIT FOR AN OVAL-TRACKED EXERCISE DEVICE

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 14 days.

(21) Appl. No.: 10/445,423

(22) Filed: May 28, 2003

(51) Int. Cl.[7] ..... A63B 22/00; A63B 22/04
(52) U.S. Cl. ..... 482/52; 482/51; 482/70
(58) Field of Search ..... 482/51–53, 70, 482/57, 79–80, 121

(56) References Cited

U.S. PATENT DOCUMENTS 3,316,898 A * 5/1967 Brown ..... 601/31
3,475,021 A * 10/1969 Ruegsegger ..... 482/71
5,690,589 A * 11/1997 Rodgers, Jr. ..... 482/57
6,251,050 B1 * 6/2001 Johnston ..... 482/57
6,277,055 B1 * 8/2001 Birrell et al. ..... 482/52

* cited by examiner

*Primary Examiner*—Stephen R. Crow
(74) *Attorney, Agent, or Firm*—Kuo-Hsiung Chiu

(57) ABSTRACT

The invention relates to a cushioning unit for an oval-tracked exercise device. A connecting element has one end pivotably attached to the elongated treadle and the other end pivotably attached to the handle bar. A lateral piece parallel to the connecting element is inwardly extended from the bottom end of the handle bars while a cushioning element is mounted on the lateral piece. When the handle bar is moved to the bottommost position, the connecting element presses against the cushioning element for achieving the expected cushioning effect, thereby preventing the operator's feet from shock caused by the reactive force of the elongated treadles.

3 Claims, 4 Drawing Sheets

CUSHIONING UNIT FOR AN OVAL-TRACKED EXERCISE DEVICE

BACKGROUND OF THE INVENTION

1. Field of the Invention

The invention relates to a cushioning unit for an oval-tracked exercise device, and more particularly, to a cushioning unit which protects the operator's feet from shock caused by the reactive force of the treadles.

2. Description of the Related Art

U.S. Pat. No. 3,316,898 describes a "REHABILITATION AND EXERCISE APPARATUS" in the year of 1967 which includes an electric motor, a speed reducer, a small sprocket, a transmission chain, a transmission sprocket, a treadle crank, two elongated plates and two rollers to simulate the oval-tracked walking exercise with both feet of an operator.

Later, a few of improvements with similar functions and effects have been disclosed to continue and extend the principles and functions of the oval-tracked exercise. Therefore, this patent plays a significant part in the development of the exercise apparatuses.

However, this kind of exercise apparatus has drawbacks that both feet of the operator are moved by the machine rather than by his own will. Therefore, the operator has to adjust himself to the speed and the rhythm of the unit during the exercise session. Otherwise, his knee and ankle joints would be easily hurt. It's more serious that this kind of injuries has no acute symptoms. The symptoms occur only when the injuries are serious.

SUMMARY OF THE INVENTION

It is a primary object of the present invention to take preventive measures to avoid the exercise injuries that are ignored by the unit suppliers for a long time. The invention includes a cushioning element for providing an appropriate cushioning effect when the treadles are located at the lowest position during the exercise session. Therefore, reactive forces of the treadles acting onto the operator's feet are eliminated for preventing his feet from injuries.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
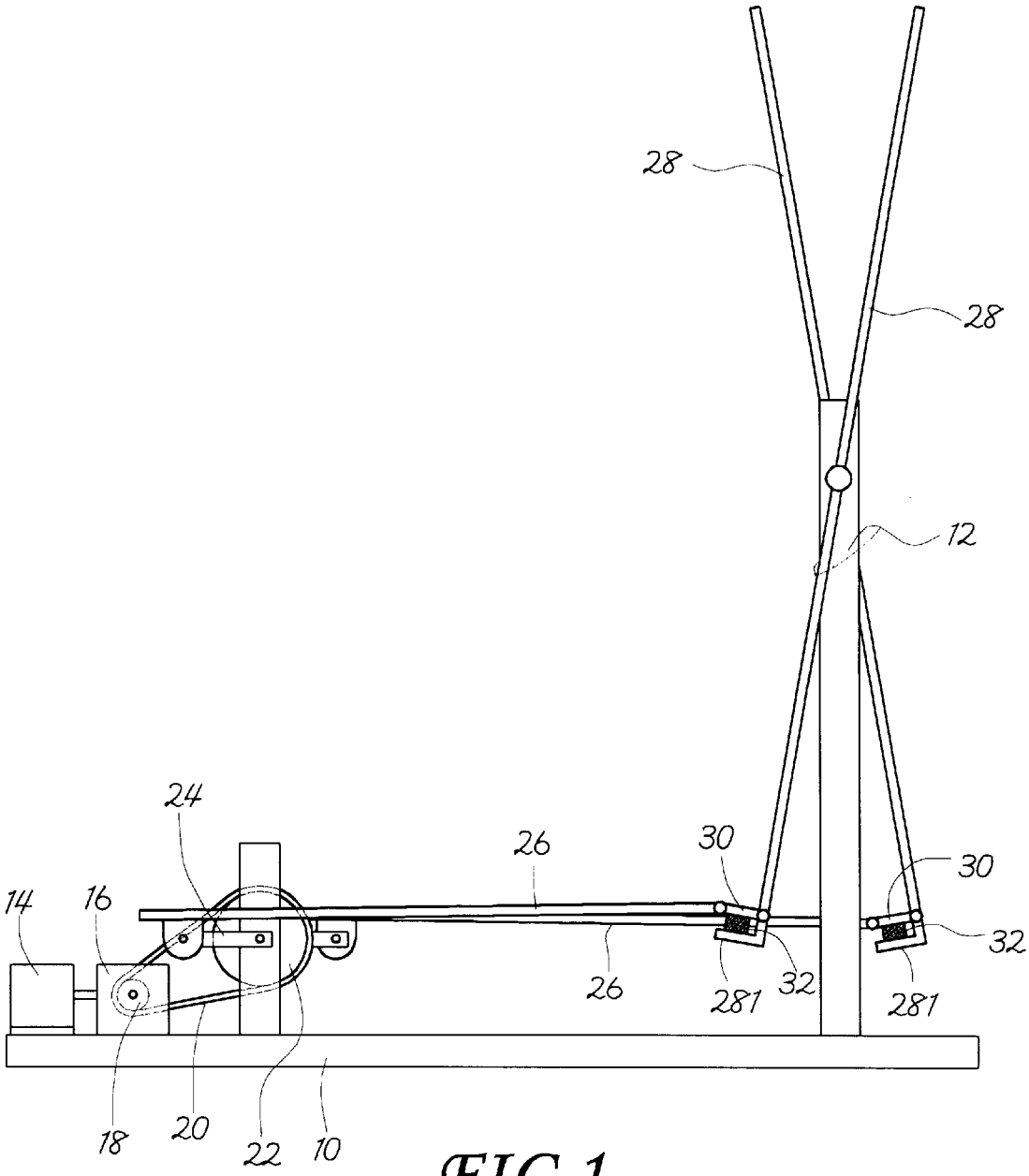
FIG. 1 is a side view of a first embodiment of the invention.
Figure 2:
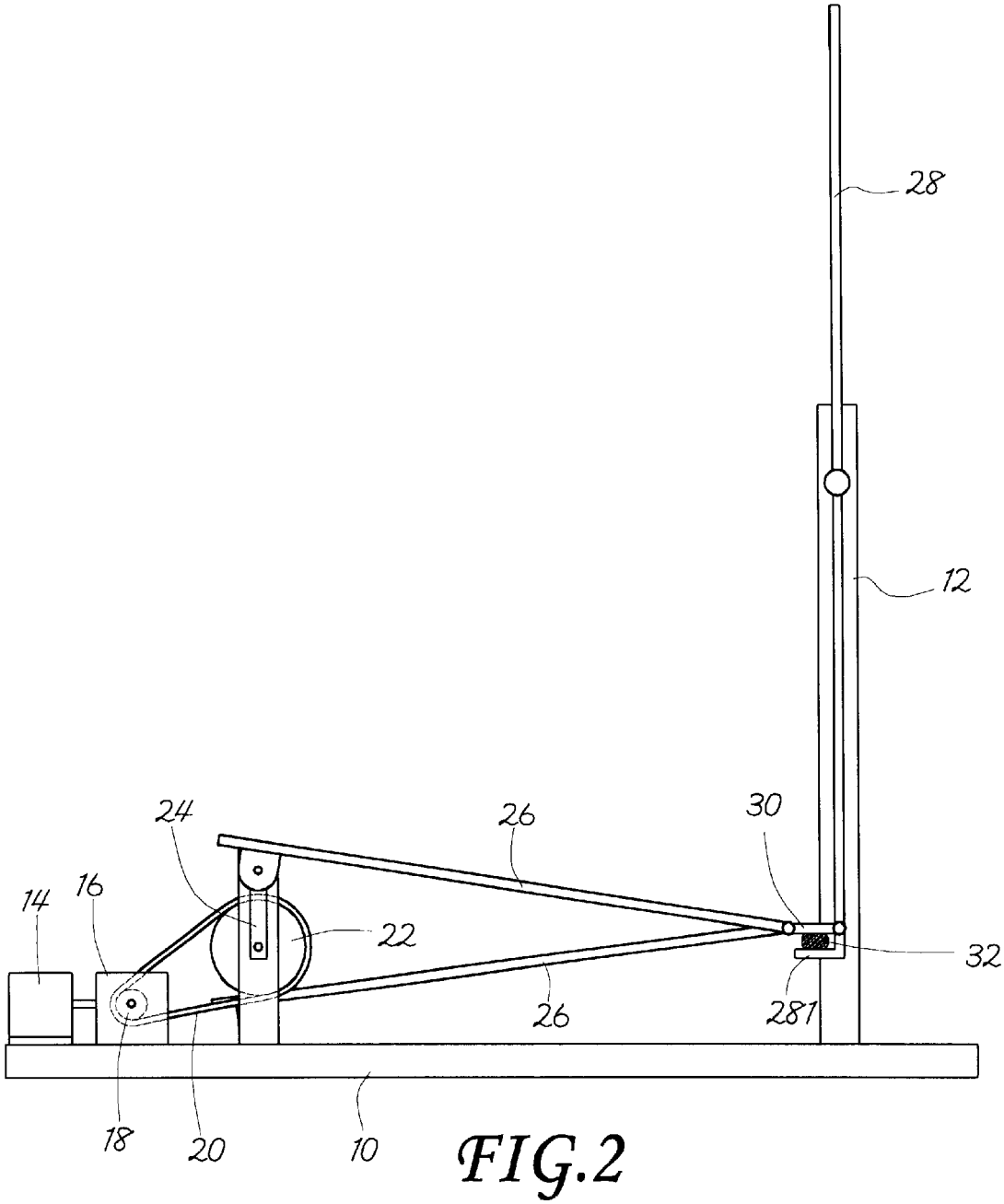
FIG. 2 is a side view of the exercise device in accordance with FIG. 1, illustrating the actuation thereof.

First of all, referring to FIGS. 1 and 2, the exercise device in accordance with the first embodiment of the present invention includes a base 10, a standing support bar 12, a motor 14, a speed reducer 16, a small sprocket 18, a transmission chain 20, a transmission sprocket 22, two treadle cranks 24, two elongated treadles 26 and two handle bars 28. The handle bars 28 are pivotally connected with the standing support bar 12. A connecting element 30 has one end pivotably attached to the elongated treadle 26 and the other end pivotably attached to the handle bar 28. A lateral piece 281 parallel to the connecting element 30 is inwardly extended from the bottom end of the handle bars 28 while a cushioning element 32 is mounted on the lateral piece 281.

After assembly of the above-mentioned components, when the handle bar is moved to the bottommost position (see FIG. 2), the connecting element 30 presses against the cushioning element 32 for achieving the expected cushioning effect, thereby preventing the operator's feet from shock caused by the reactive force of the elongated treadles 26.

Figure 3:
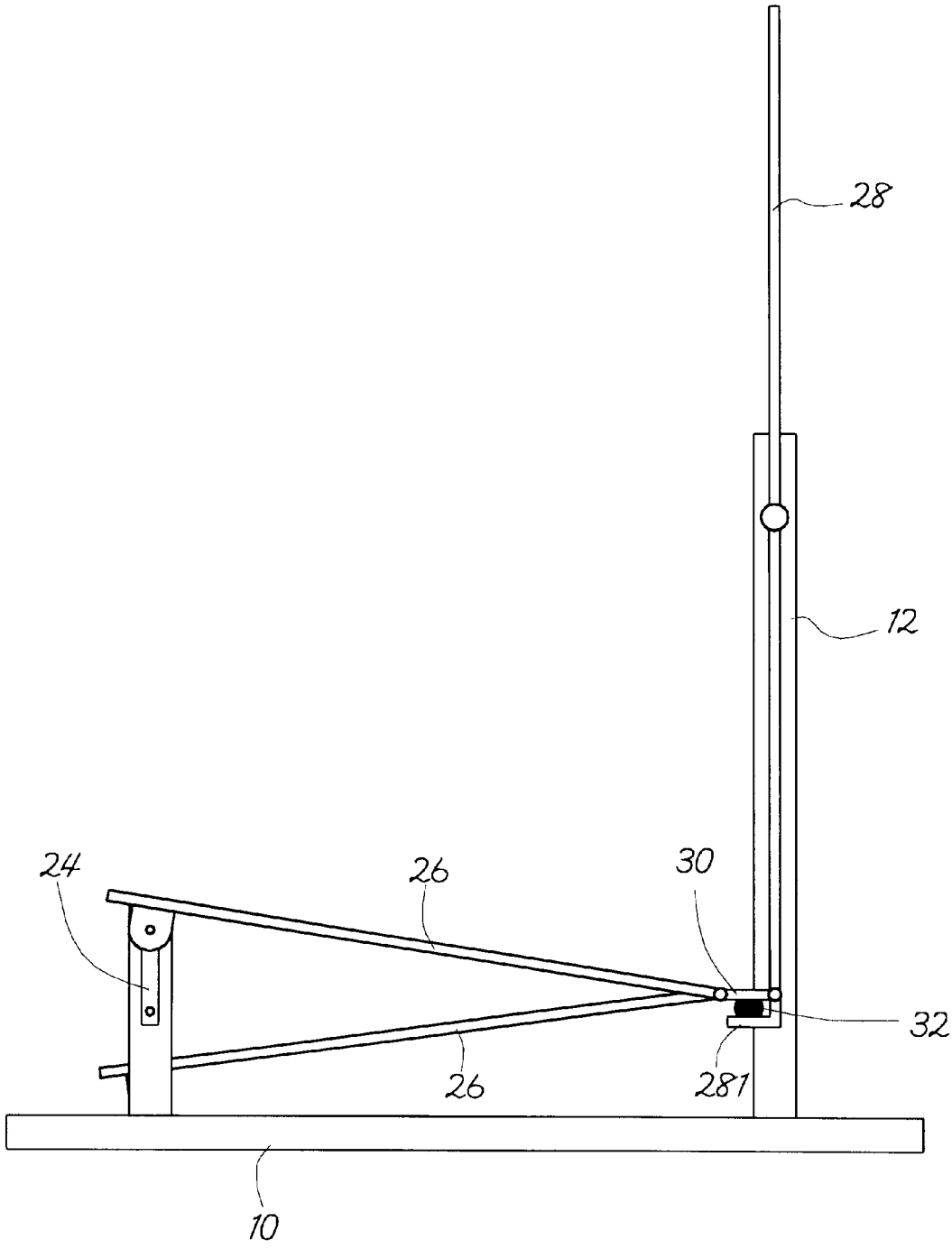
FIG. 3 is a side view of a second embodiment of the invention.

Referring to FIG. 3, the exercise device in accordance with the second embodiment of the present invention includes a base 10, a standing support frame 12, a small sprocket 18, a transmission chain 20, a transmission sprocket 22, two treadle cranks 24, two elongated treadles 26 and two handle bars 28. The handle bars 28 are pivotally connected with the standing support bars 12. A connecting element 30 has one end pivotably attached to the elongated treadle 26 and the other end pivotably attached to the handle bar 28. A lateral piece 281 parallel to the connecting element 30 is inwardly extended from the bottom end of the handle bars 28 while a cushioning element 32 is mounted on the lateral piece 281.

Figure 4:
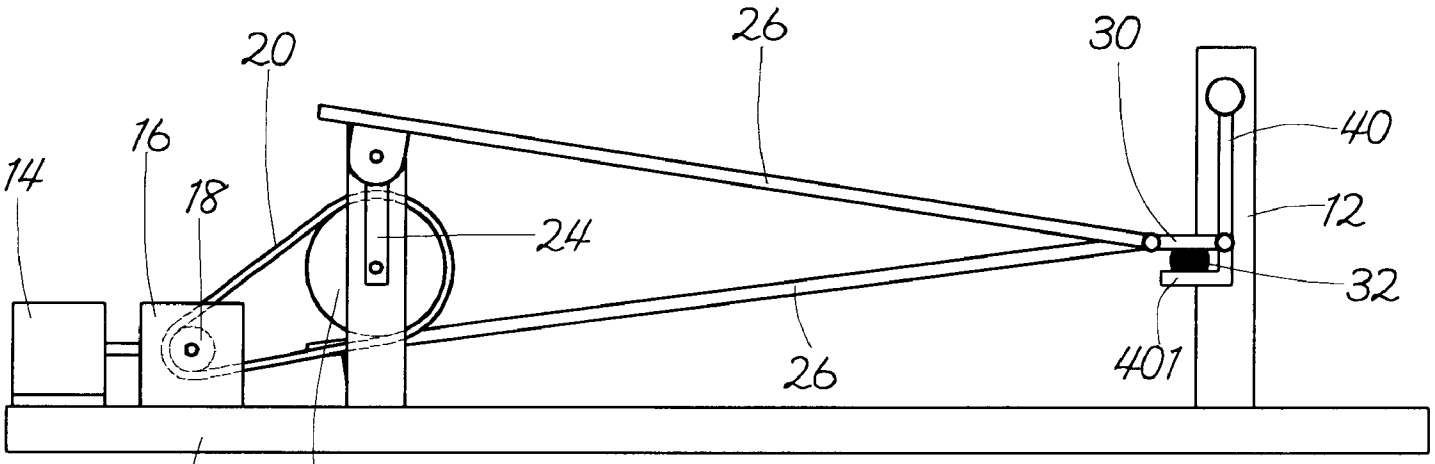
FIG. 4 is a side view of a third embodiment of the invention.

Referring to FIG. 4, the exercise device in accordance with the third embodiment of the present invention includes a base 10, a standing support frame 12, a small sprocket 18, a transmission chain 20, a transmission sprocket 22, two treadle cranks 24, two elongated treadles 26 and two connecting rods 40. The connecting rods 40 are pivotally connected with the standing support bars 12. A connecting element 30 has one end pivotably attached to the elongated treadle 26 and the other end pivotably attached to the connecting rod 40 at the other end thereof. A lateral piece 401 parallel to the connecting element 30 is inwardly extended from the bottom end of the connecting rods 40 while a cushioning element 32 is mounted on the lateral piece 401. This is a modification of the first embodiment of the invention.

The cushioning element 32 can be constructed as rubber pad, spring, pneumatic cylinder, hydraulic cylinder, etc.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An exercise device with treadles moving in an oval track, comprising:

a) a frame assembly having a base, a standing support bar;

b) a motor;

c) a speed reducer;

d) a treading unit having a small sprocket, a transmission chain, a transmission sprocket, two treadle cranks, two elongated treadles and two handle bars, the handle bars being pivotally connected with the standing support bar; and e) a cushioning unit comprising:

i) a connecting element having one end pivotably attached to the elongated treadle and the other end pivotably attached to the handle bar;

ii) a lateral piece parallel to the connecting element and inwardly extended from the bottom end of the handle bars; and iii) a cushioning element mounted on the lateral piece.

2. An exercise device with treadles moving in an oval track, comprising:

a) a frame assembly having a base, a standing support bar;

b) a treading unit having a small sprocket, a transmission chain, a transmission sprocket, two treadle cranks, two elongated treadles and two handle bars, the handle bars being pivotally connected with the standing support bar; and c) a cushioning unit comprising:

i) a connecting element having one end pivotably attached to the elongated treadle and the other end pivotably attached to the handle bar;

ii) a lateral piece parallel to the connecting element and inwardly extended from the bottom end of the handle bars; and iii) a cushioning element mounted on the lateral piece.

3. An exercise device with treadles moving in an oval track, comprising:

a) a frame assembly having a base, a standing support bar;

b) a motor;

c) a speed reducer;

d) a treading unit having a small sprocket, a transmission chain, a transmission sprocket, two treadle cranks, two elongated treadles and two connecting rods, the connecting rods being pivotally connected with the standing support bar; and e) a cushioning unit comprising:

i) a connecting element having one end pivotably attached to the elongated treadle and the other end pivotably attached to the connecting rod;

ii) a lateral piece parallel to the connecting element and inwardly extended from the bottom end of the connecting rods; and iii) a cushioning element mounted on the lateral piece.

* * * * *